US011177565B2

(12) United States Patent
Hojjat et al.

(10) Patent No.: US 11,177,565 B2
(45) Date of Patent: Nov. 16, 2021

(54) SIMPLIFIED MULTI-BAND MULTI-BEAM BASE-STATION ANTENNA ARCHITECTURE AND ITS IMPLEMENTATION

(71) Applicant: COMMUNICATION COMPONENTS ANTENNA INC., Kanata (CA)

(72) Inventors: Nasrin Hojjat, Kanata (CA); Sadegh Farzaneh, Kanata (CA); Lin-Ping Shen, Kanata (CA); Bret Jones, Kanata (CA); Hua Wang, Kanata (CA); Minya Gavrilovic, Ottawa (CA); Des Bromley, Kanata (CA); Willi Lotz, Kanata (CA); Jacob Van Beek, Stittsville (CA)

(73) Assignee: COMMUNICATION COMPONENTS ANTENNA INC., Ontario (CA)

( * ) Notice: Subject to any disclaimer, the term of this patent is extended or adjusted under 35 U.S.C. 154(b) by 0 days.

(21) Appl. No.: 15/576,763

(22) PCT Filed: Feb. 29, 2016

(86) PCT No.: PCT/CA2016/050209
§ 371 (c)(1),
(2) Date: Nov. 24, 2017

(87) PCT Pub. No.: WO2016/187701
PCT Pub. Date: Dec. 1, 2016

(65) Prior Publication Data

US 2018/0301801 A1 Oct. 18, 2018

Related U.S. Application Data

(60) Provisional application No. 62/166,376, filed on May 26, 2015.

(51) Int. Cl.
*H01Q 1/24* (2006.01)
*H01Q 1/52* (2006.01)
(Continued)

(52) U.S. Cl.
CPC ..... *H01Q 1/523* (2013.01); *H01Q 1/246* (2013.01); *H01Q 3/2605* (2013.01); *H01Q 5/40* (2015.01);
(Continued)

(58) Field of Classification Search
CPC ..... H01Q 1/246; H01Q 1/523; H01Q 3/2605; H01Q 5/40; H01Q 5/42; H01Q 5/48;
(Continued)

(56) References Cited

U.S. PATENT DOCUMENTS 5,434,580 A * 7/1995 Raguenet ..... H01Q 5/42 343/700 MS
6,529,166 B2 3/2003 Kanamaluru
(Continued)

FOREIGN PATENT DOCUMENTS

WO 2007011295 A1 1/2007

OTHER PUBLICATIONS

ISA/CA, International Search Report and Written Opinition for corresponding PCT Application No. PCT/CA2016/050209 dated May 26, 2016.

(Continued)

*Primary Examiner* — Andrea Lindgren Baltzell
*Assistant Examiner* — Patrick R Holecek
(74) *Attorney, Agent, or Firm* — Sofer & Haroun, LLP

(57) ABSTRACT

A multi-band generalized antenna architecture using two or more types of antenna element is presented. Linear arrays of a first type of antenna element are used for one or more frequencies while a second antenna element type is used for other frequencies. The second type of antenna element is located between the linear arrays of the first antenna element type. The second antenna element type may be arranged in a staggered configuration or they may be arranged as linear arrays as well. The first type of antenna element may be a
(Continued)

patch antenna element while the second type of antenna element may be a dipole antenna element. The patch antenna element may be used for high band frequencies while the dipole antenna element may be used in low band frequencies. The spacing in vertical direction is not equal to minimize the effect of arrays on each other.

15 Claims, 18 Drawing Sheets

(51) Int. Cl.

| | |
|---|---|
| ***H01Q 3/26*** | (2006.01) |
| ***H01Q 9/16*** | (2006.01) |
| ***H01Q 21/08*** | (2006.01) |
| ***H01Q 21/24*** | (2006.01) |
| ***H01Q 21/30*** | (2006.01) |
| ***H01Q 5/48*** | (2015.01) |
| ***H01Q 9/28*** | (2006.01) |
| ***H01Q 21/06*** | (2006.01) |
| ***H01Q 5/40*** | (2015.01) |

(52) U.S. Cl.
CPC ..... *H01Q 5/48* (2015.01); *H01Q 9/16* (2013.01); *H01Q 9/285* (2013.01); *H01Q 21/062* (2013.01); *H01Q 21/065* (2013.01); *H01Q 21/24* (2013.01); *H01Q 21/30* (2013.01); *H01Q 21/08* (2013.01)

(58) Field of Classification Search
CPC .... H01Q 9/285; H01Q 21/061; H01Q 21/062; H01Q 21/065; H01Q 21/08; H01Q 21/24; H01Q 21/26; H01Q 21/28; H01Q 21/30
See application file for complete search history.

(56) References Cited

U.S. PATENT DOCUMENTS

| | | | | |
|---|---|---|---|---|
| 7,053,832 | B2 * | 5/2006 | Manzione ..... | H01Q 21/065 343/700 MS |
| 8,354,972 | B2 | 1/2013 | Borja et al. | |
| 8,437,712 | B2 | 5/2013 | Melis | |
| 9,293,809 | B2 * | 3/2016 | Teillet ..... | H01Q 1/246 |
| 9,472,845 | B2 * | 10/2016 | Teillet ..... | H01Q 3/38 |
| 9,711,853 | B2 * | 7/2017 | Foo ..... | H01Q 1/246 |
| 2007/0030208 | A1 | 2/2007 | Linehan | |
| 2013/0002505 | A1 | 1/2013 | Teillet | |

OTHER PUBLICATIONS

EU Search Report dated Aug. 22, 2019.

* cited by examiner

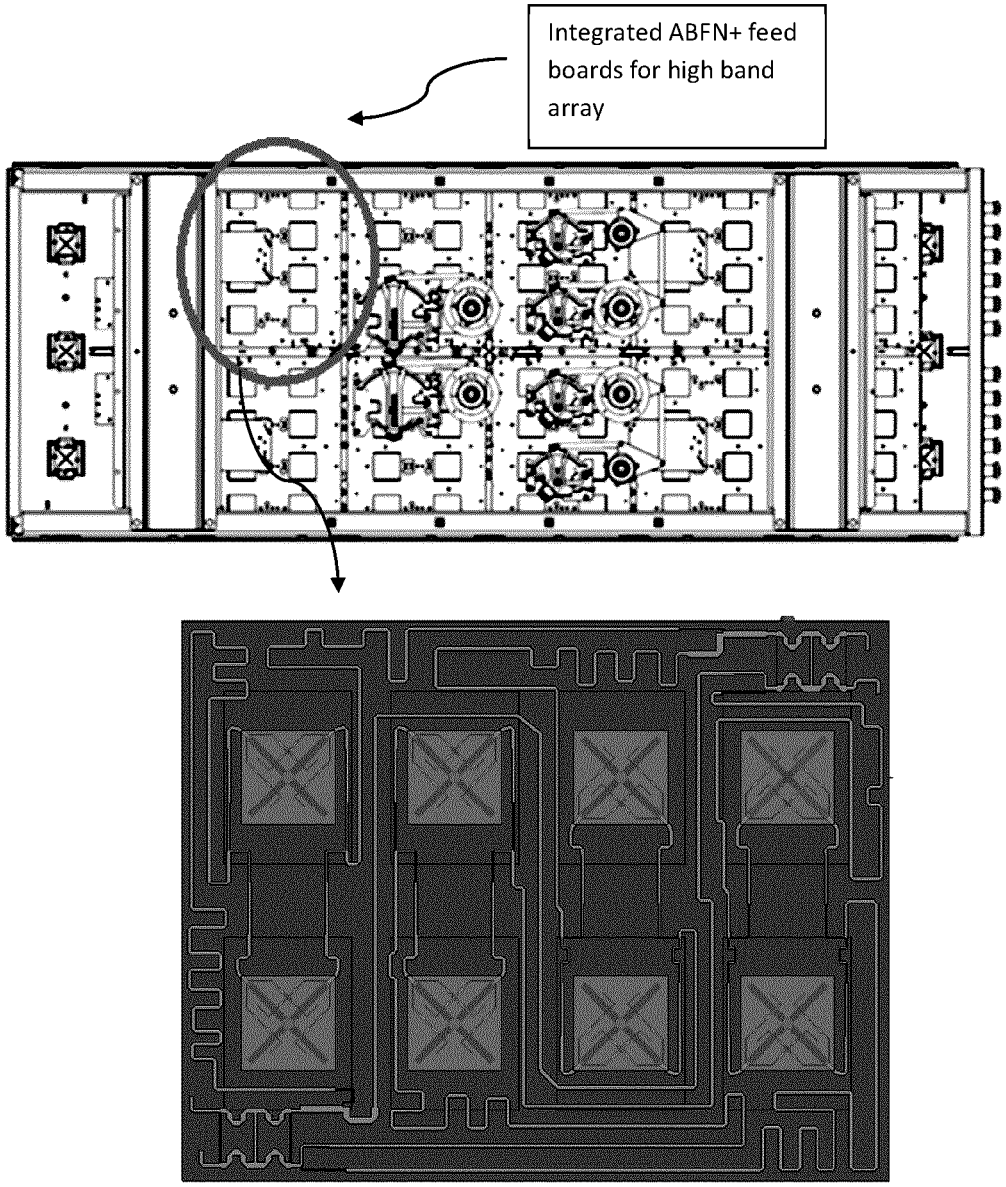
Integrated ABFN+ feed boards for high band array

SIMPLIFIED MULTI-BAND MULTI-BEAM BASE-STATION ANTENNA ARCHITECTURE AND ITS IMPLEMENTATION

TECHNICAL FIELD

This invention relates to the field of telecommunications. More specifically, this invention relates to multi-band multibeam base-station antenna arrays.

BACKGROUND

Multi-band multibeam base station array antennas are able to support multiple radio frequency bands over multiple sectors. These multifunctional antennas can improve the capacity and throughput of the communication system while occupying almost the same physical space on the communication towers. Commonly, multi-band antennas utilize multi-band elements in their architecture. One example of such a state of the art dual-band antenna is that found in U.S. Pat. No. 7,283,101 (see FIG. 1). This antenna supports two radio frequency bands with one 65 deg beam per polarization for each band. This antenna uses a plurality of both dual-band and single band elements.

The use of multi-band elements in multi-band antennas has several shortcomings. The non-similarity between multi-band elements and single band elements in a multi-band antenna may cause antenna pattern distortion. Furthermore, the different center phases of each multi-band element and single band element may cause dispersion over frequency bands and this thereby weakens the antenna's performance.

Multi-band elements, including dual-band elements, are also complex in both structure and composition/design. This complexity may be problematic for manufacturing, and may also cause Passive Intermodulation, or PIM, issues.

Multiband multibeam planar arrays in particular are more challenging to design especially when it comes to positioning the single band and multiband elements near each other in the limited available space. These planar arrays usually are used to provide narrower azimuth beamwidths such as 33 degree beams (or narrower) per polarization for either or both bands (compared to a 65 degree azimuth beamwidth for standard 3 sector implementations). The narrower beams can be directed toward boresight or they can be directed in other directions for bisector/multi-sector applications. These planar arrays may also include two or more independent antennas in the same reflector for MIMO applications. For these planar arrays, space, both in front of and the back of the reflector, is more limited due to more complex beamforming networks. As well, space also becomes limited due to the required number of single band and multiband elements for radiating in the required bands. These antenna multi-band elements, with their more complex feed networks and their more complex radiating elements, will cause difficulties when positioning the elements and the feedboards in the available space in both the front and back of the reflector. One option to avoid such issues is to have two completely separate arrays for two different frequency bands on the same reflector. Unfortunately, this option tends to considerably increase the size of the antenna. There may also be other specific approaches available for certain architectures. However, such approaches are not easily extendable to a unique solution for designing planar multiband and multibeam arrays. Methods and techniques which reduce the size of the whole antenna while increasing antenna efficiency would therefore be desirable for telecommunications devices.

There is therefore a need to mitigate, if not overcome, the shortcomings of the prior art and to, preferably, create a compact multi-beam multiband antenna array with increased effectiveness.

SUMMARY

The present invention provides a multibeam multiband architecture that can be implemented in many different applications as shown in different embodiments of this invention. The concept is not limited to these embodiments and can be used in a variety of other implementations.

In one embodiment, the present invention provides systems and devices relating to a multi-beam, multi-band antenna system. A first antenna array is used for low frequency band beams and this first antenna array uses low band antenna elements. At least one second antenna array, for high frequency band beams, is also present with the second antenna array elements being interspersed among the first antenna elements. The second antenna elements may be spaced within the first antenna array with the second antenna elements being placed in between the first antenna elements. Groups of second antenna elements may be regularly spaced among the first antenna elements with spacing between groups being larger than element spacing within each group.

The architecture of the current invention uses two or more types of antenna element. In one embodiment, patch antenna elements may be used for high frequency band beams while dipole antenna elements may be used for low frequency band beams. The second antenna elements may be deployed in groups of rows with each group of rows being placed between elements or rows of elements of the first antenna array. The longitudinal spacing between groups of rows of the second antenna elements may be uniform and may be different from the longitudinal spacing between elements within each group of rows. This is done to minimize the coupling effect of antenna elements of the first and second types of antenna elements. Preferably, the antenna elements of different types are selected for minimum coupling between different types. In this embodiment, patch antenna elements were used for high band frequencies and dipole antenna elements were used for low band frequencies.

The present invention also includes a new design for an azimuth beamformer and related architectural implementation for improving the crossover point and sidelobe of the beams for high frequency band antenna arrays.

In a first aspect, the present invention provides an antenna system comprising:

- a first antenna array comprising a plurality of first antenna array elements, said first antenna array being for use with low frequency band signals;
- at least one second antenna array comprising a plurality of second antenna array elements, said at least one second antenna array being for use with high frequency band signals;

wherein

- said second antenna array elements are interspersed among said first antenna array elements;
- said first antenna array elements are of a first type of antenna array elements;
- said second antenna array elements are of a second type of antenna array elements.

The present invention provides a generalized planar multiband multibeam antenna system architecture that mixes different antenna array element types or kinds and which produces multiple beams at multiple frequencies.

BRIEF DESCRIPTION OF THE DRAWINGS

The embodiments of the present invention will now be described by reference to the following figures, in which identical reference numerals in different figures indicate identical elements and in which:

FIG. 3C shows a back view of the embodiment of the present invention shown in FIG. 3;

Figure 1:
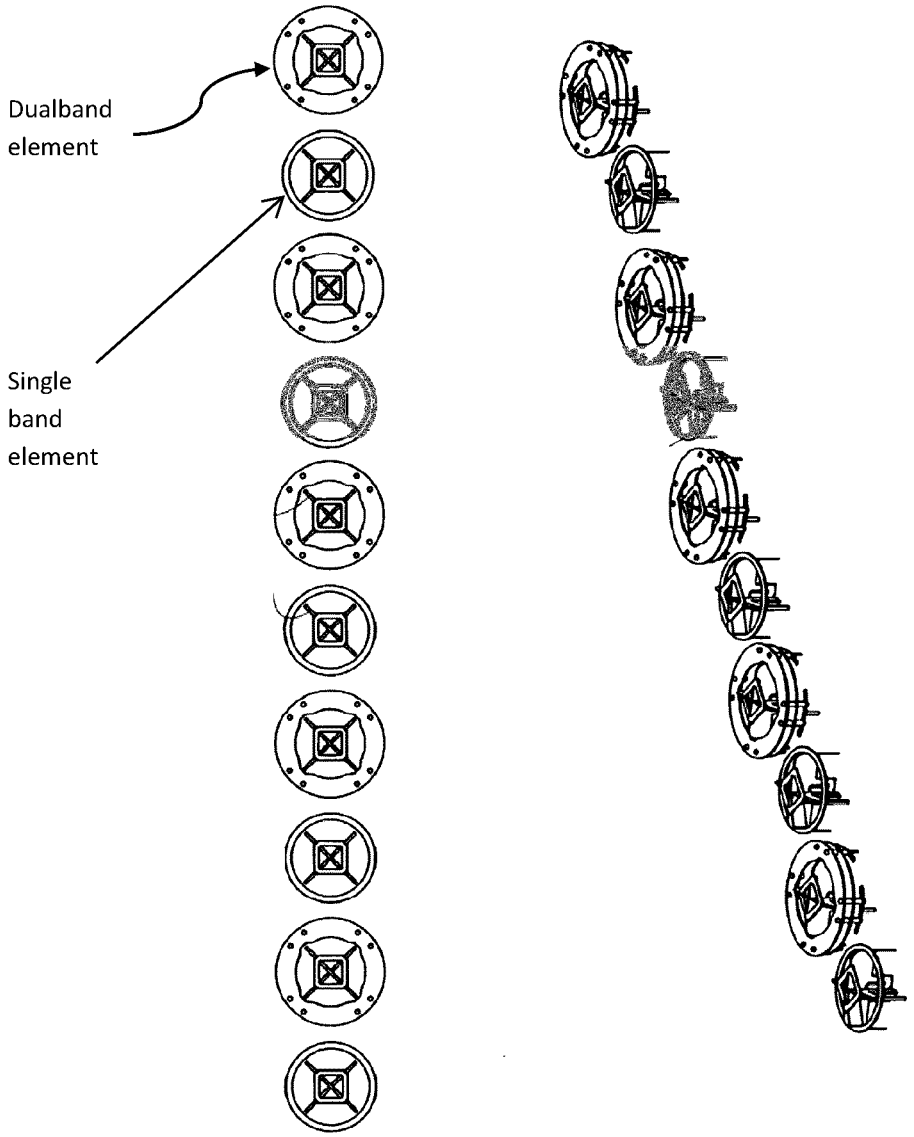
FIG. 1 shows a prior art dual band array which uses dual band elements.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION

The present invention provides an approach for implementing compact multi-standard multi-beam antennas without the need to use multi-band elements. A variety of embodiments are shown as examples and the invention is not limited to these embodiments. Rather than utilizing dual-band elements for a dual-band antenna, the present invention utilizes a combination of different element types for low-band and/or high-band applications, without introducing high grating lobes.

Presented below are four main embodiments of the invention:

Embodiment A

A 12 port bisector antenna: Two independent arrays of high band antenna elements (with each array being able to operate in different bands (such as 1710-2360 MHz and 2300-2690 MHz) or in the same band) each with two 33 degree bisector beams per polarization and one array of low band with two 33 bisector beams per polarization;

Embodiment B

A 6 port hybrid 65 degree antenna: One high band antenna array with two 33 degree bisector beams per polarization and one low band antenna array with one 65 degree beam per polarization;

Embodiment C

A 6 port 33 degree beam antenna: Two independent arrays of high band antenna with one 33 degree beam per polarization and one low band array with one 33 degree beam per polarization; and

Embodiment D

An 18 port multibeam multiband antenna: One high band array with 6 beams per polarization and a low band array with 3 beams per polarization.

Figure 2:
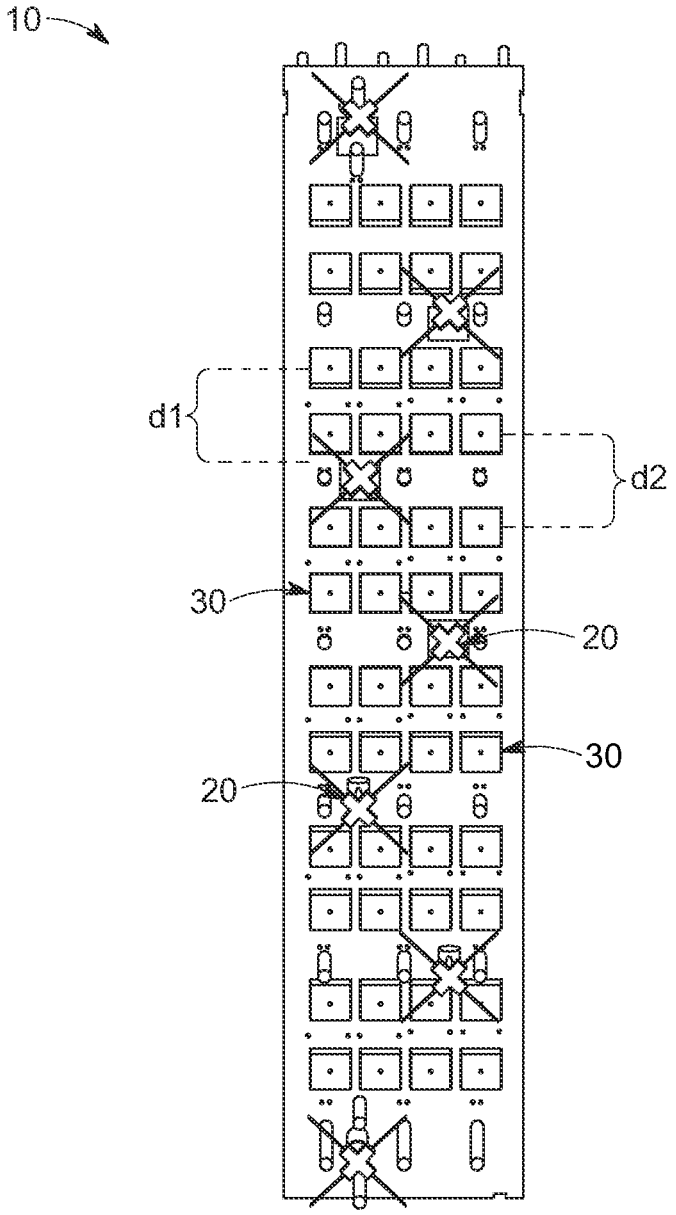
FIG. 2 shows a front view photograph of one embodiment of the present invention.

Referring to FIG. 2, an antenna array according to Embodiment B detailed above is presented. It should be noted that Embodiment B is presented first as this is the simplest embodiment of the four presented in this document. FIG. 2 can therefore serve as a basis for the descriptions and terms which will be used in conjunction with the other embodiments.

Referring to FIG. 2, the antenna system 10 has two antenna arrays. The first antenna array uses first antenna elements 20 while the second antenna array uses second antenna elements 30. The first antenna array uses seven first antenna array elements 20 while the second antenna array uses 48 second antenna array elements 30. The second antenna array elements are arranged into groups of eight second antenna array elements 30 per group. For each group, there are two latitudinally arranged rows of four second antenna array elements per row. Within each row, the four second antenna array elements are latitudinally equally spaced apart from adjacent second antenna array elements. It should, however, be noted that the latitudinal spacing between elements within a row may be unequal. The latitudinal spacing may be unequal to shape the azimuth pattern. For this embodiment, the latitudinal spacing between elements was equal. Within each group, a longitudinal spacing d1 separates the two rows.

Longitudinally (i.e. along the long axis of the antenna system), the groups of second array elements of the second array are separated by first antenna array elements 20. As can be seen, each group of eight second antenna array elements are spaced apart from other groups with a single first antenna array element separating one group from another. Between the groups of second antenna array elements, a longitudinal spacing d2 separates any two adjacent groups of second antenna array elements. It should be noted that the longitudinal spacing d2 may be greater than the longitudinal spacing d1. Also, preferably, d1 and d2 are not equal to one another. It should, however, be noted that experiments indicate that, for some specific implementations, there might be a preference for the d1 distance being greater than d2 distance. If d1 were equal to d2, high grating lobes at higher frequencies may be produced.

As can be seen from FIG. 2, the first antenna array elements 20 are dipole antenna elements while the second antenna array elements 30 are patch antenna elements. Other antenna elements may, of course, be possible. As an example, both types of antenna array elements may be dipoles with metallic dipoles being used for high frequency band elements and PCB dipoles being used for low frequency band elements. Similarly, quad dipole antenna elements may be used for the high frequency band elements while cross dipole antenna elements may be used for the low frequency band elements. Alternatively, slot antenna elements may be used for high frequency band elements and dipole antenna elements may be used for low frequency band elements. Preferably, each low frequency band element has a small physical footprint so that the high frequency elements can first be located or placed properly.

The arrangement in FIG. 2 allows for minimal coupling effect between the low-band dipole antenna array elements and the high-band antenna element patches when compared to other combinations of element types. Such an arrangement also minimizes the size of the overall antenna system, creating a very compact dual-band antenna. The simplified architecture of such an arrangement can be applied to a variety of multi-beam multi-band antenna as shown in different embodiments of the invention.

The difference in spacing between the values for d1 and d2 as explained above serves multiple purposes. As dipole elements have very small footprints on or near the reflector surface, they cause much less radiation interference to the radiation mechanism of patch elements when compared to other low band elements such as a patch element. The wings of dipoles which are partially extended over the patch elements only produce a small interference effect. This architecture therefore creates a smaller overall antenna array size for the same number of antenna elements with minimal coupling between low band and high band elements. As an example, it can be seen in the arrangement in FIG. 2 that two rows of patch antenna elements are located between every two dipole antenna array elements. The difference between the d1 and d2 spacings also minimizes the dipole effect on the patches and the coupling between the patch antenna elements and the dipole antenna elements, thereby improving antenna performance.

Figure 2A:
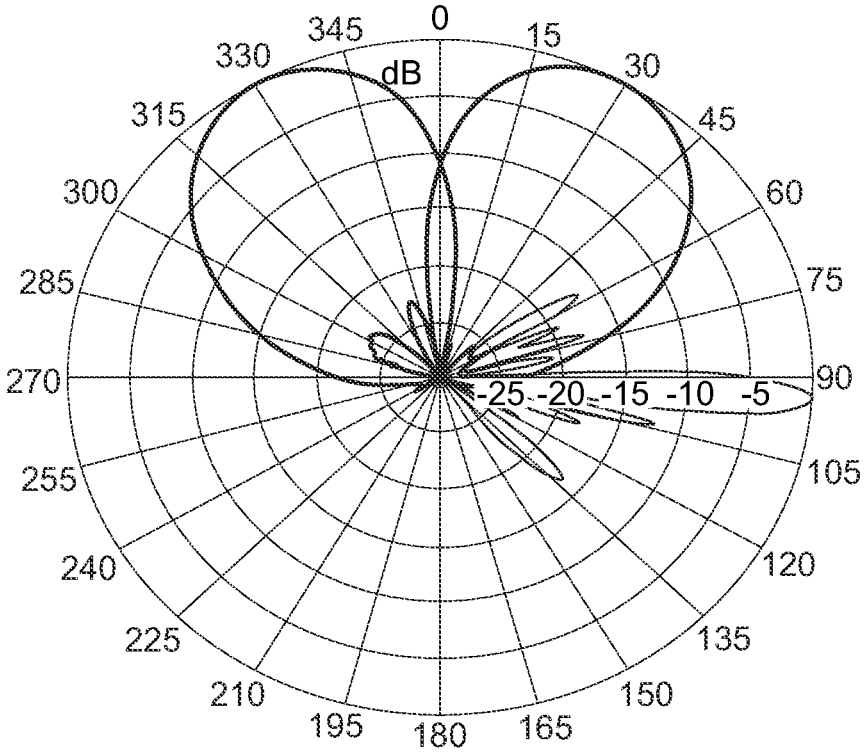
FIG. 2A illustrates azimuth and elevation patterns for the antenna system illustrated in FIG. 2 implemented to produce a high frequency band 33 degree bisector dual beam and a low frequency band 65 degree single beam.
Figure 2A:
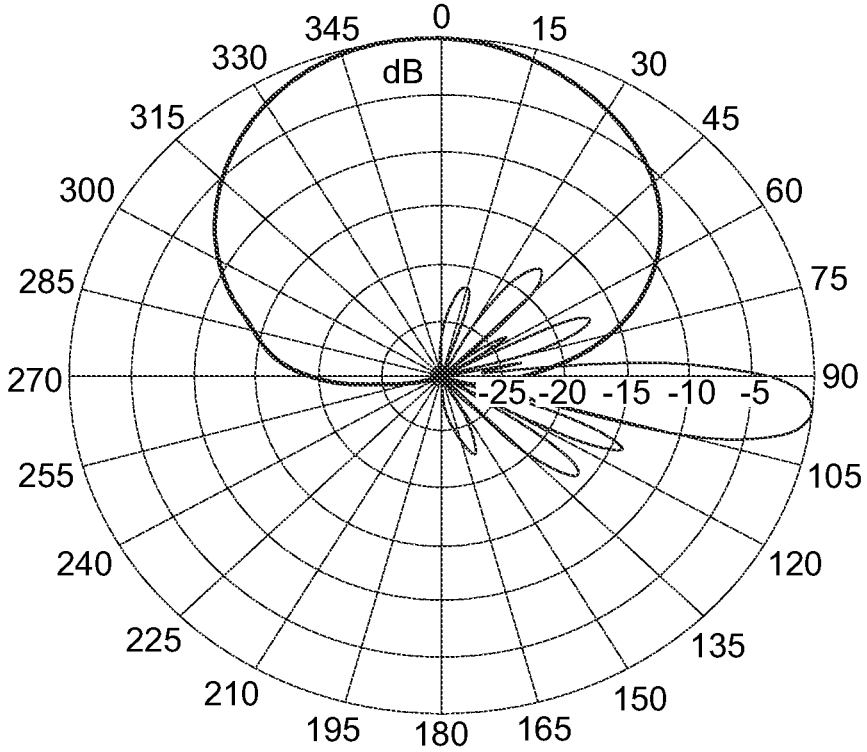

Referring to FIG. 2A, azimuth plots for the two arrays illustrated in FIG. 2 are presented. The top plot is an azimuth plot of the bisector beams for the high band antenna array while the bottom plot is for the low band array.

Figure 3:
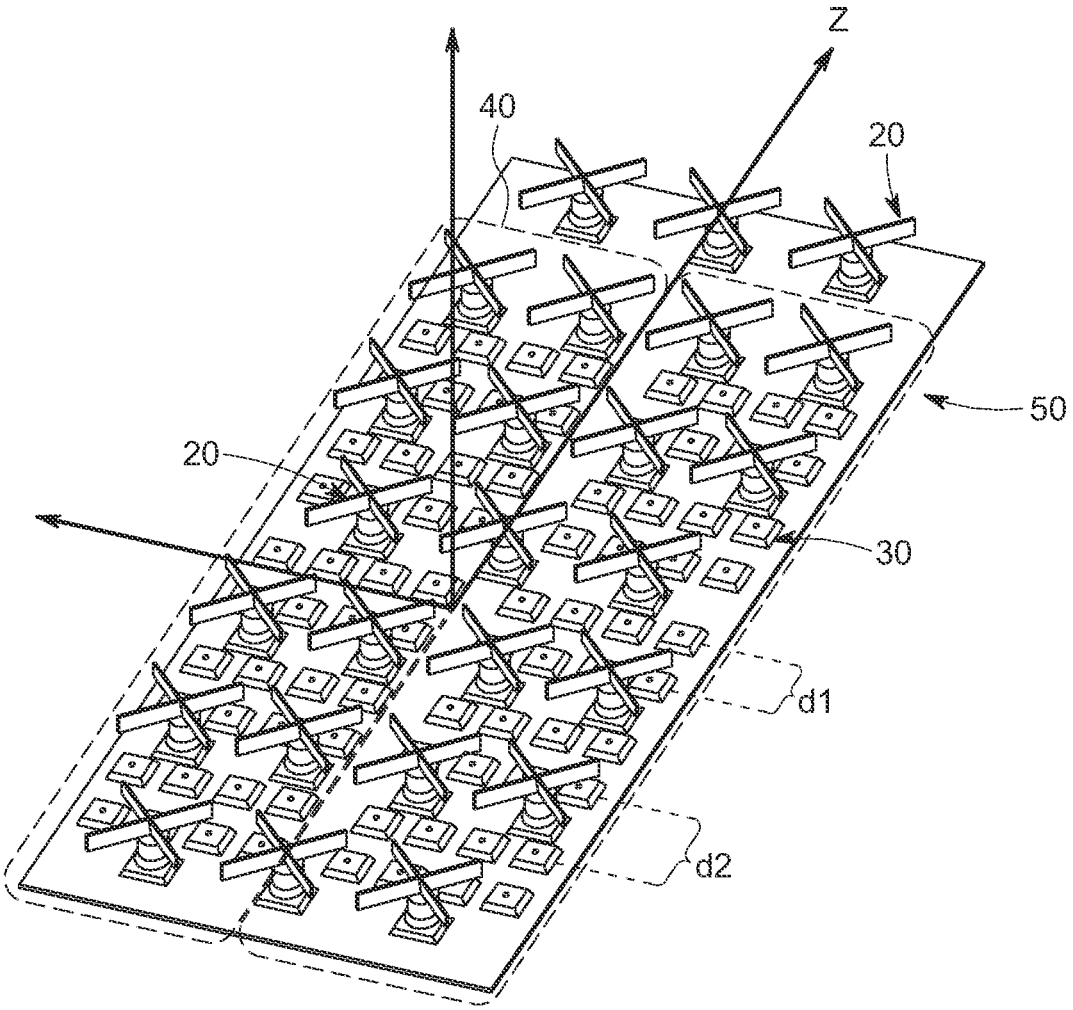
FIG. 3 shows a perspective view of another embodiment of the present invention with this embodiment being a dual-beam, dual-band array producing twelve beams.

Referring to FIG. 3, a more complex embodiment of the invention is illustrated. This embodiment conforms to Embodiment A listed above. In this embodiment, a single low band antenna array is used in conjunction with two high band antenna arrays. The single low band antenna array consists of multiple dipole antenna elements 20. These dipole antenna elements are positioned in a 3-4-4-3-4-4-3 configuration. This means that, from the top of the figure, the top row of dipole antenna elements (or first array antenna elements) has 3 elements in the row. The next two rows each has 4 first antenna array elements while the following row has only three first antenna array elements. Of the last three rows, the first two each have four dipole antenna elements per row while the last row only has three antenna elements in the row. The two high band antenna arrays are circled in FIG. 3 and are labeled as "Highband Array1" and "Highband Array2". The two high band antenna arrays 40, 50 can be separated from one another by the longitudinal axis illustrated as axis z in FIG. 3. Each one of high band antenna arrays 40, 50 has 40 second antenna array elements 20. As can be seen, each one of the two second antenna arrays is divided into five groups of second antenna array elements with each group having two rows of four second antenna array elements per row. Each group of second antenna array elements is separated from adjacent groups (within the same array) by one or two first antenna array elements. Similar to the embodiment illustrated in FIG. 2, each group is spaced apart from an adjacent group by a distance d2. Within each group, each row of antenna elements is longitudinally separated from an adjacent row by a distance d1. As with the embodiment in FIG. 2, the value for d1 is less than the value for d2. However, of course other relationships between the values of d1 and d2 are possible.

In this embodiment of the invention, the standard architecture of both the front (FIG. 3A) and back (FIG. 3C) of the antenna is manipulated to achieve a compact overall antenna architecture. In one implementation of the antenna system in FIG. 3, the dipole antenna elements are radiating at 698-960 MHz bands and are longitudinally spaced apart from other dipole antenna elements by 270 mm. The antenna patch elements in this implementation are radiating at 1.71-2.36 GHz bands and the patch antenna elements are longitudinally spaced from other patch antenna elements by about 118-152 mm.

In another implementation, the configuration in FIG. 3 has two high-band arrays, one with 1710-2360 MHz elements and the other with 2490-2690 MHz elements.

The above described arrangements allow for a smaller total footprint of the antenna. For example, two dual-beam high-band antennas according to the embodiment illustrated in FIG. 3 may be placed in the same physical place as a single conventional dual-beam low-band antenna array.

There are, of course, other improvements related to the embodiment illustrated in FIG. 3. One concept illustrated in FIG. 3 is the use of 2 or more rows of high band patch antenna array elements between rows of low band dipole antenna array elements. The antenna system architecture illustrated in FIG. 3 has particular advantages for the B-band (low-band) as it optimizes crossover and azimuth side lobe level (SLL) for the low-band. This compromises between SLL (which is better in a 4 column array) and the crossover point (which is low in a 4 column array and high in a 3 column array). As can be seen, for the low band dipole antenna array elements in FIG. 3, there is mix of both 3 columns and 4 columns with the first, fourth, and seventh rows having 3 columns while the rest of the low band array having 4 columns. This arrangement is clearly visible in FIGS. 3 and 3A.

In addition to the advantages noted above, the architecture illustrated in FIG. 3 provides an antenna system with very good return loss (RL) and cross polarity isolation for both bands at various electrical tilts, including 2-12 low-band tilts and 0-9 high-band tilts.

Figure 3A:
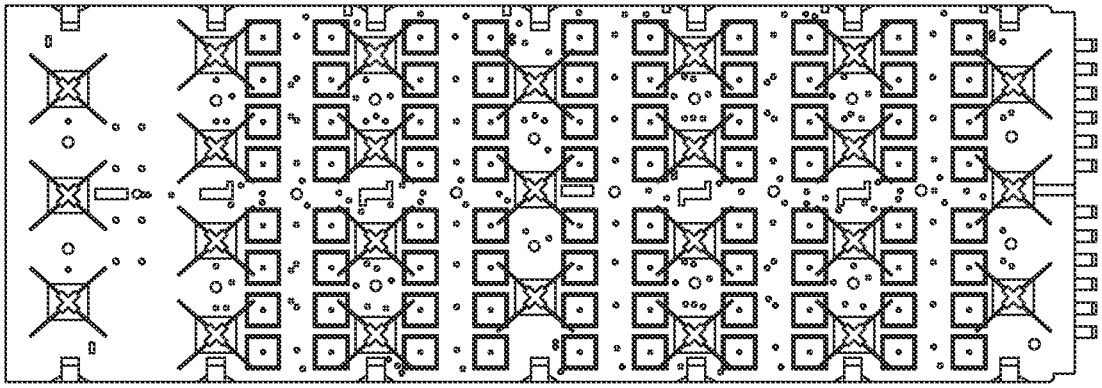
FIG. 3A shows a front view schematic of the embodiment of the present invention shown in FIG. 3.
Figure 3B:
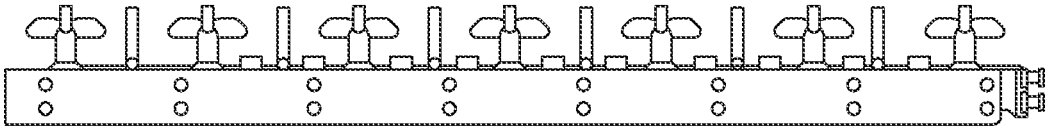
FIG. 3B is a side view of the embodiment of the present invention shown in FIG. 3.

For a better view of the antenna system architecture in FIG. 3, FIG. 3A is front view of the antenna system clearly illustrating the 3443443 arrangement for low band antenna array and the spacings between the groups of high band antenna elements in the two high band antenna arrays. FIG. 3B is a side vide of the antenna system illustrated in FIG. 3 showing the relative size difference between the low band dipole antenna elements and the high band patch antenna elements.

FIG. 3C provides a back view of the antenna system in FIG. 3 and illustrates another aspect of the invention. For this antenna array, each group of two rows of high band antenna array elements is fed in a novel manner that addresses the issue of excessive cabling at the back of the antenna system and to further lower the interaction between dipole antenna elements and patch antenna elements. By integrating the azimuth feed-boards with two azimuth beam forming networks (ABFN) it was possible to have two high band independent arrays side by side in the limited space in the back of antenna. This avoids the issue of having an excessive number of cables. These integrated feed-boards allow for patch antennas to be utilized with fewer cables than conventional antennas (see FIG. 3C showing the feed network for a group of two rows of high band antenna elements). To match with the limited space in this embodiment, elements are fed both from the front and the rear of the reflector. The elements can be fed from the front using PCB feedlines on top or by using cables. For this embodiment of the invention, the patch antenna elements are slot-fed from the back of the reflector while the dipole antenna elements are fed from the front of the reflector using cables. In one implementation of the present invention, a pedestal is introduced underneath the dipole elements to facilitate the feeding of these dipole elements.

Figure 4:
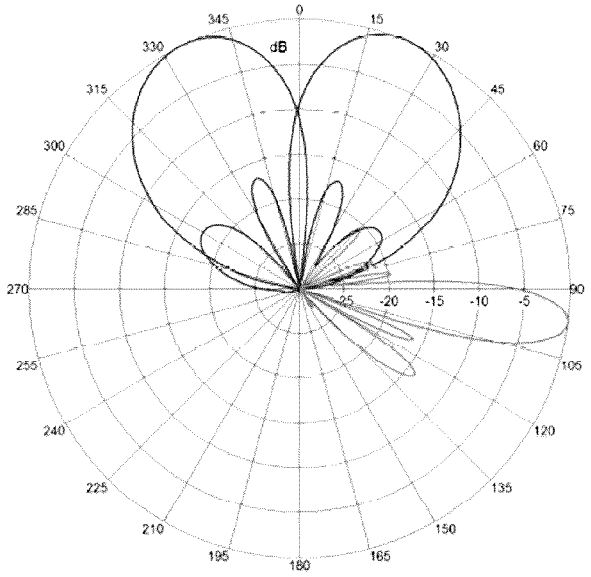
FIG. 4 shows the two azimuth bisector beams and elevation patterns in low-band elements achieved by the new 3443443 architecture in FIG. 3 for 849 MHz and 761 MHz.
Figure 4:
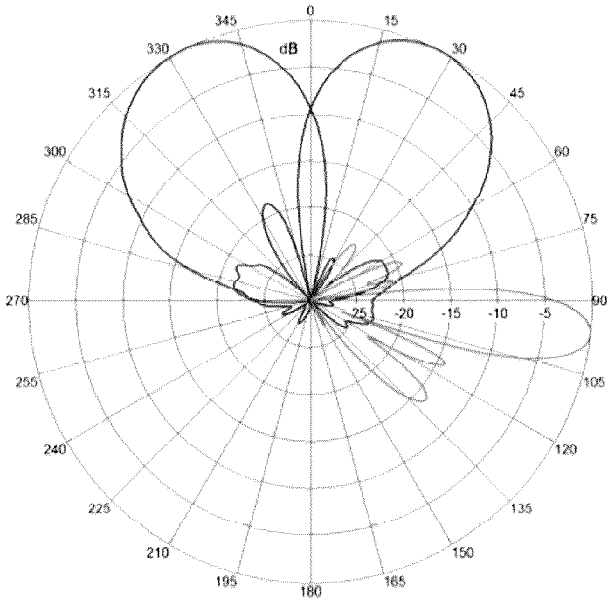

The present invention also includes novel phase adjustment methods that consider the phase centers of the each linear array with different number of columns to produce left and right beams with proper elevation patterns. As noted above, the low band array in the embodiment illustrated in FIG. 3 includes both 3 and 4 column antenna element rows in the configuration. FIG. 4 show the azimuth and elevation patterns in low-band elements achieved by the new 3443443 architecture and cabling for 849 MHz and 761 MHz beams, respectively.

As another novel feature of the present invention, an AFBN may be implemented with asymmetric weighting for the high-band antenna array elements. This would provide a higher cross over value compared to symmetrical weightings when applied for every group of eight patch antenna array elements. The directionality of the ABFN may also be reversed for every other group of high band antenna array elements to remove the frequency dispersion from the crossover point and to optimize the crossover value and SLL.

Figure 5:
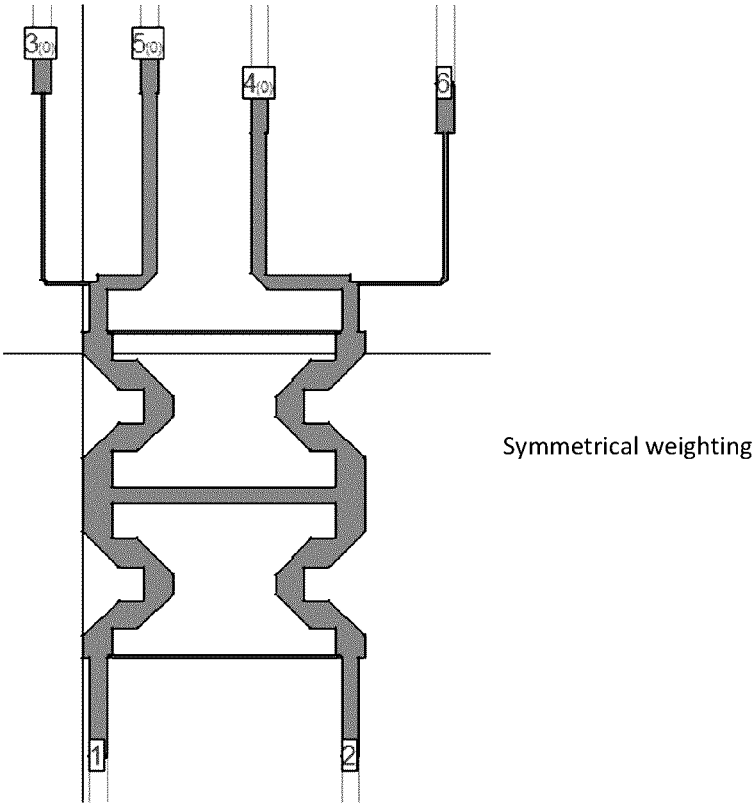
FIG. 5 shows the azimuth beam forming network design for high-band elements with symmetrical weightings.
Figure 5A:
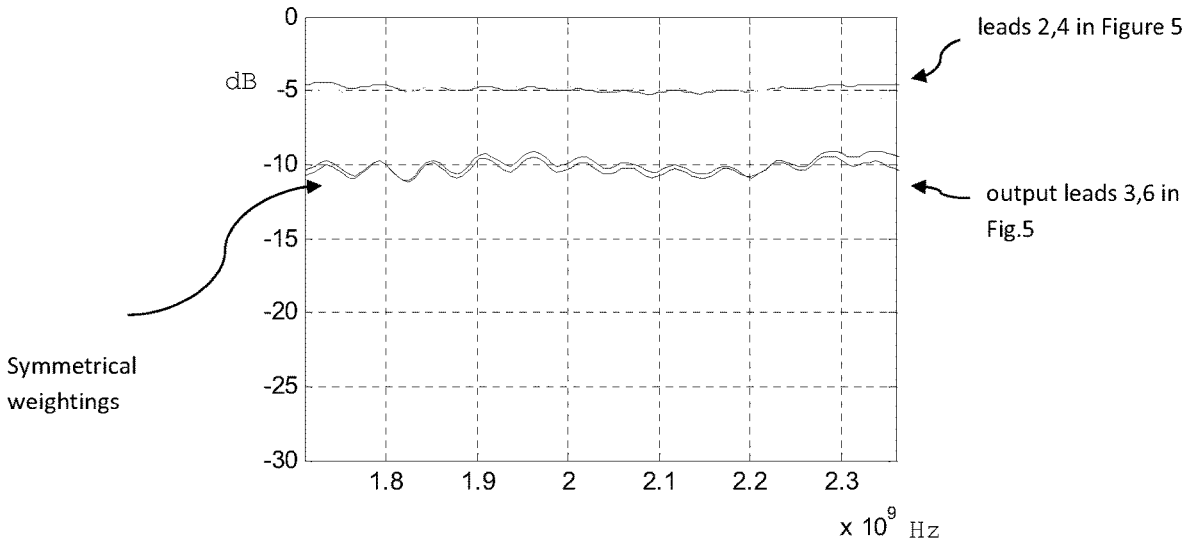
FIG. 5A illustrates the effects of symmetric weightings and the resulting pattern including crossover value for the azimuth beamforming network design in FIG. 5.
Figure 5A:
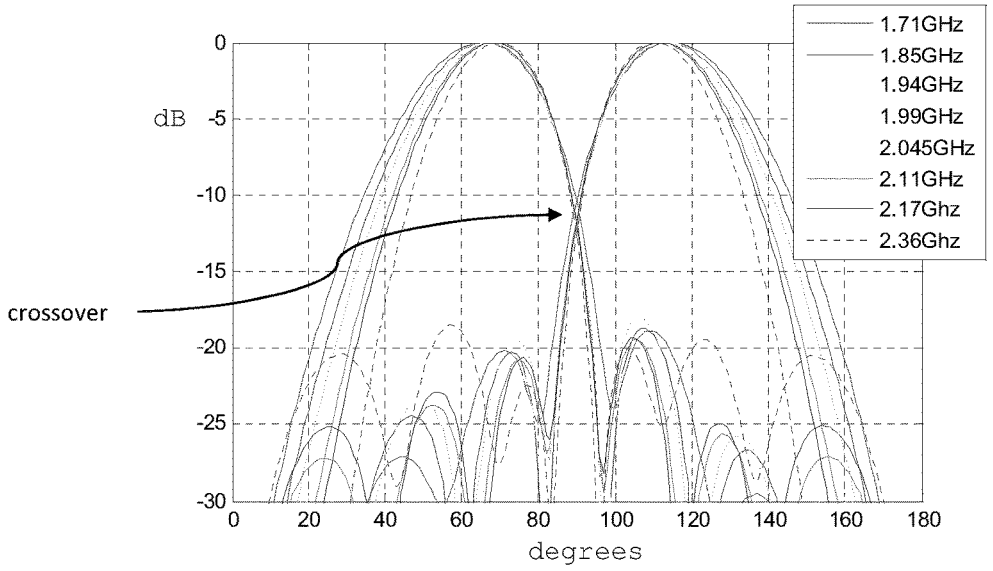

FIG. 5 shows an example of a conventional symmetrical ABFN design for high-band elements. As can be seen, two inputs (see bottom of figure with leads labelled as 1 and 2) are fed to four outputs (see top of figure with leads labelled as 3 and 5 being derived from input lead 1 (directly from lead 1 and with a 90 degree phase shift from input lead 2) while leads labelled 4 and 6 are derived from input lead 2 (directly from lead 2 and with a 90 degree phase shift from input lead 1) to produce two beams. The weighting for leads 3 and 5 are symmetrical with the weighting for leads 4 and 6. The results for this conventional design are illustrated in the plots of FIG. 5A.

Figure 5B:
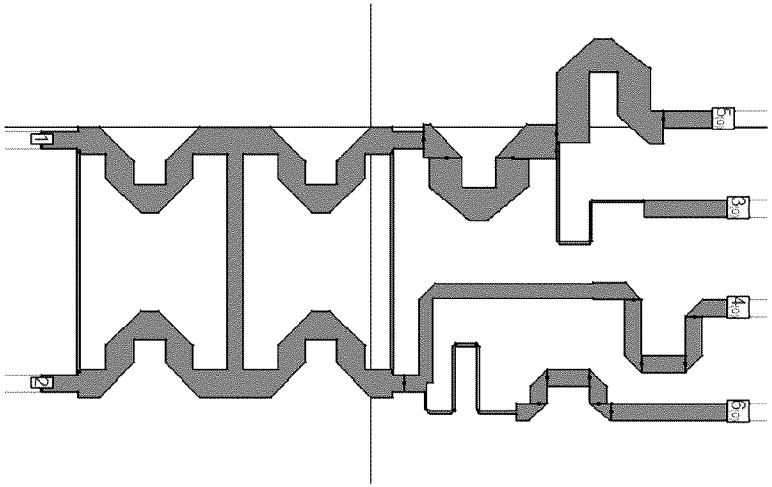
FIG. 5B shows the azimuth beam forming network design for high frequency bands using asymmetrical weighting.

In contrast to the design in FIG. 5, FIG. 5B illustrates an ABFN design with asymmetrical weighting. As can be seen, input lead 1 still directly feeds output leads 5 and 3 (with a phase shift for the input from lead 2) while input lead 2 still directly feeds output leads 4 and 6 (with a phase shift for the input from lead 1). However, the weighting for leads 5 and 3 no longer mirror the weighting for leads 4 and 6. This asymmetrical design includes an impedance transformation to provide a power divider with a one to ten power ratio for one of the outputs of a hybrid coupler.

Figure 5C:
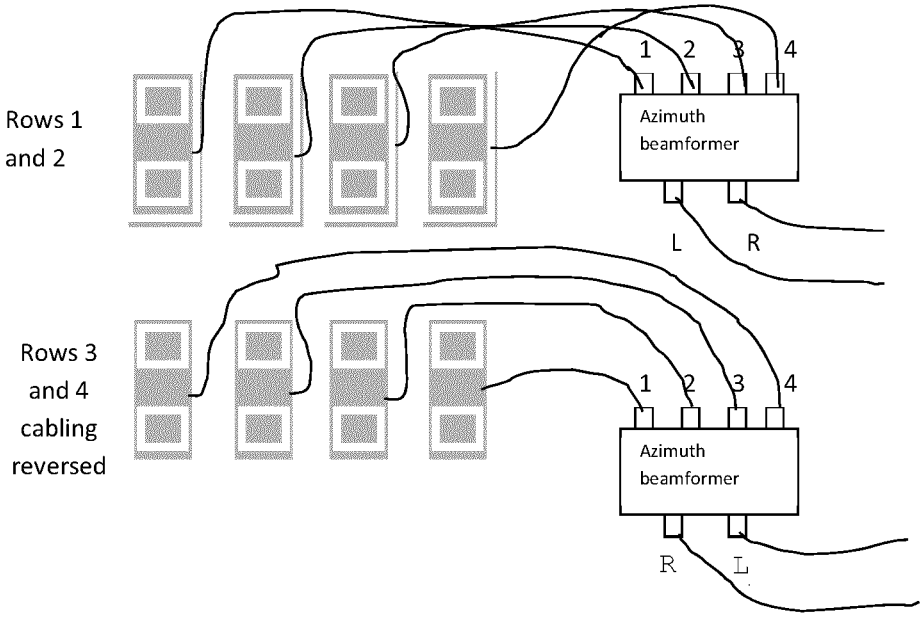
FIG. 5C illustrates the architectural implementation for the azimuth beamforming network (ABFN) design illustrated in FIG. 5B.

Referring to FIG. 5C, an architectural implementation of the novel ABFN asymmetrical weighting design is illustrated. As can be seen, the connections of the ABFN are reversed for every other group of high band elements to remove the frequency dispersion from the crossover point and to optimize the crossover value and SLL. To better explain FIG. 5C, rows 1 and 2 corresponds to one group of high band antenna array elements while rows 3 and 4 corresponds to another (and adjacent) group of high band antenna array elements. In the configuration in FIG. 3, there would be a row of low band antenna array elements between rows 2 and 3. The azimuth beamformer in FIG. 5C would have two inputs—one for the left beam and one for the right beam. Output leads 1 and 2 of the beamformer would feed the two leftmost columns for rows 1 and 2 while output leads 3 and 4 would feed the two rightmost columns for rows 1 and 2. For rows 3 and 4, the reverse would be implemented: output leads 1 and 2 would feed the two rightmost columns while output leads 3 and 4 would feed the two leftmost columns. As well, for rows 3 and 4, the positions of the left and right input would be reversed from their positions for rows 1 and 2.

It should be noted that although the Figures and description only address using asymmetric weightings for the AFBN on the high band antenna array elements, this concept may also be used for the low band antenna array elements. Specifically, asymmetrical weighting may be used for the AFBN in the 4 column rows in the 3443443 architecture with the directionality of the AFBN being switched between the first two rows of 4 columns and the second two rows of 4 columns.

Figure 5D:
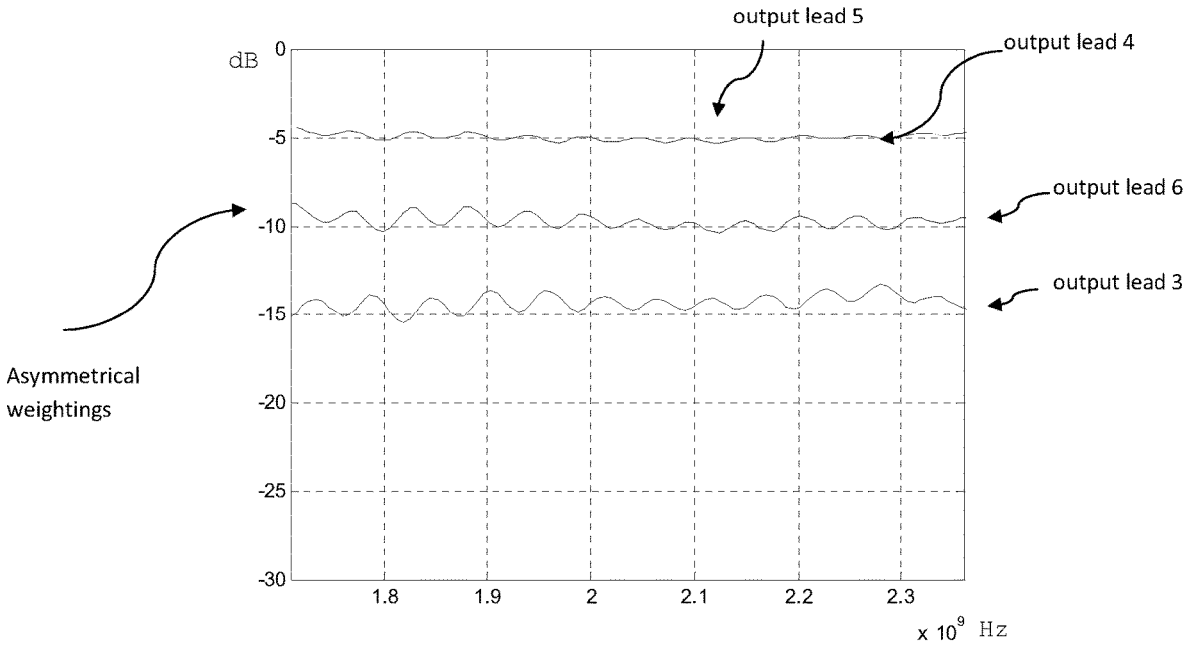
FIG. 5D illustrates the effects of asymmetric weightings and the resulting pattern including crossover for the azimuth beamforming network design in FIGS. 5B and 5C.
Figure 5D:
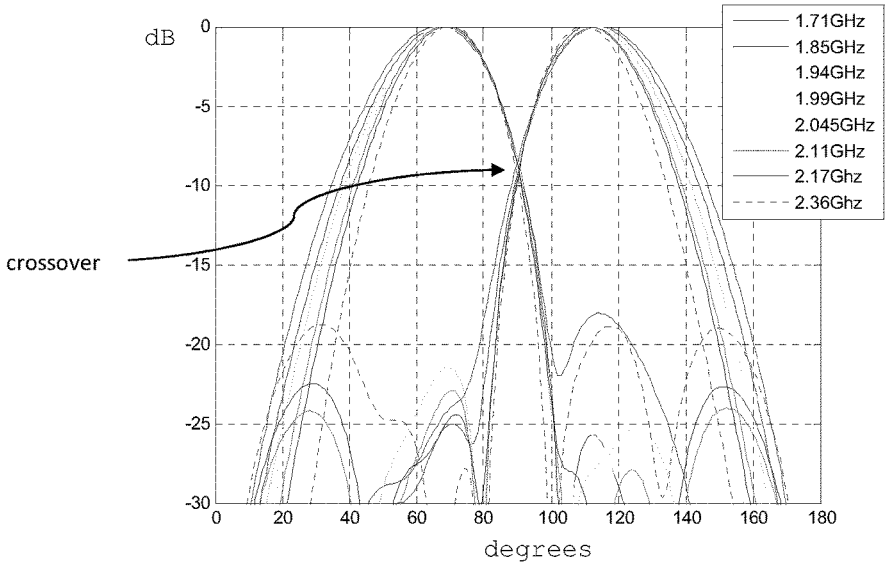

The results of the novel ABFN design with asymmetrical weighting are shown in FIG. 5D. As can be seen, the crossover point has moved up in the graph and the signal response for output leads 3 and 6 are now separated from one another as opposed to being very close to one another as in the plot in FIG. 5A.

Figure 6:
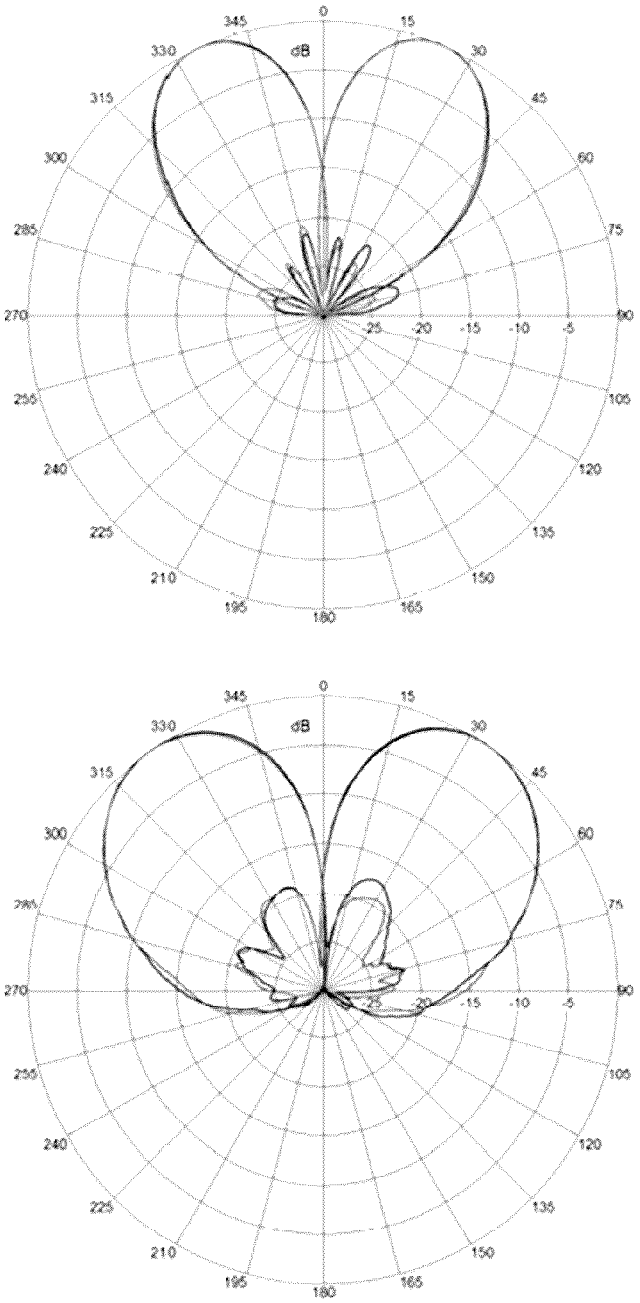
FIG. 6 shows the azimuth plots for an implementation of the ABFN with symmetrical weightings illustrated in FIG. 5 at 1710 MHz and 2170 MHz.
Figure 7:
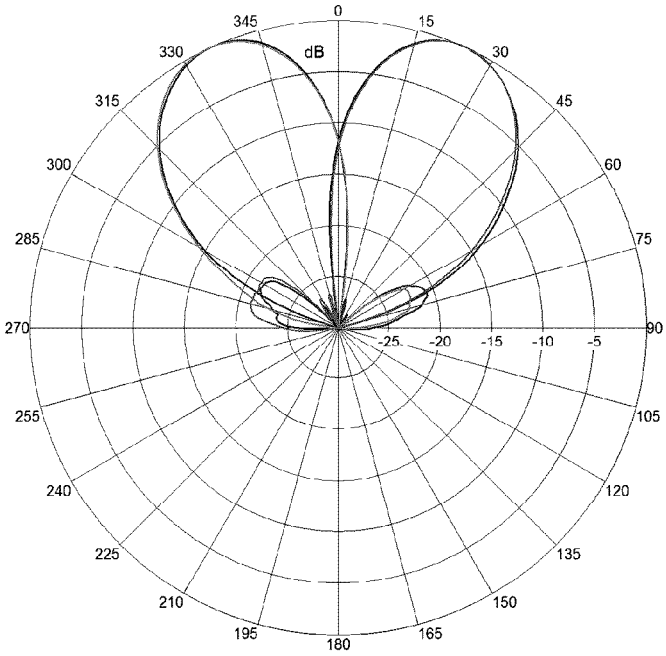
FIG. 7 shows azimuth plots for an implementation of the ABFN design using asymmetrical weightings illustrated in FIGS. 5B and 5C at 1710 MHz and 2170 MHz.
Figure 7:
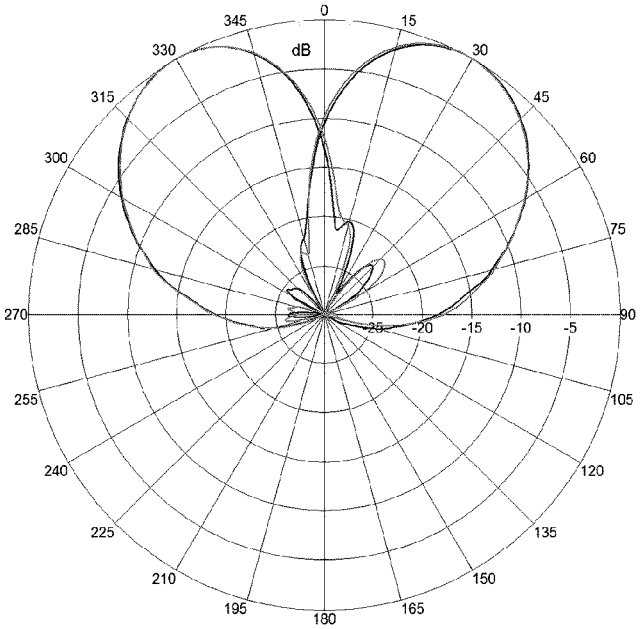

The results of this novel ABFN design are further shown in reference to FIGS. 6 and 7. FIG. 6 show the azimuth plots of an implementation of an ABFN conventional design with symmetrical weightings for 2.17 and 1.71 GHz. FIG. 6 shows that an ABFN with symmetrical weightings produces dispersive crossover behavior for the two frequencies and also that the crossover value is low (around −14 dB to −17 dB).

In contrast to the above, FIG. 7 show azimuth plots for an ABFN design with using asymmetrical weightings. These plots are for implementations at 2.17 GHz and 1.71 GHz. As can be seen from the plots, no dispersive crossover is visible, and an optimal crossover, namely at −11 dB, is achieved for the full band pattern while providing very low SLL.

Figure 8:
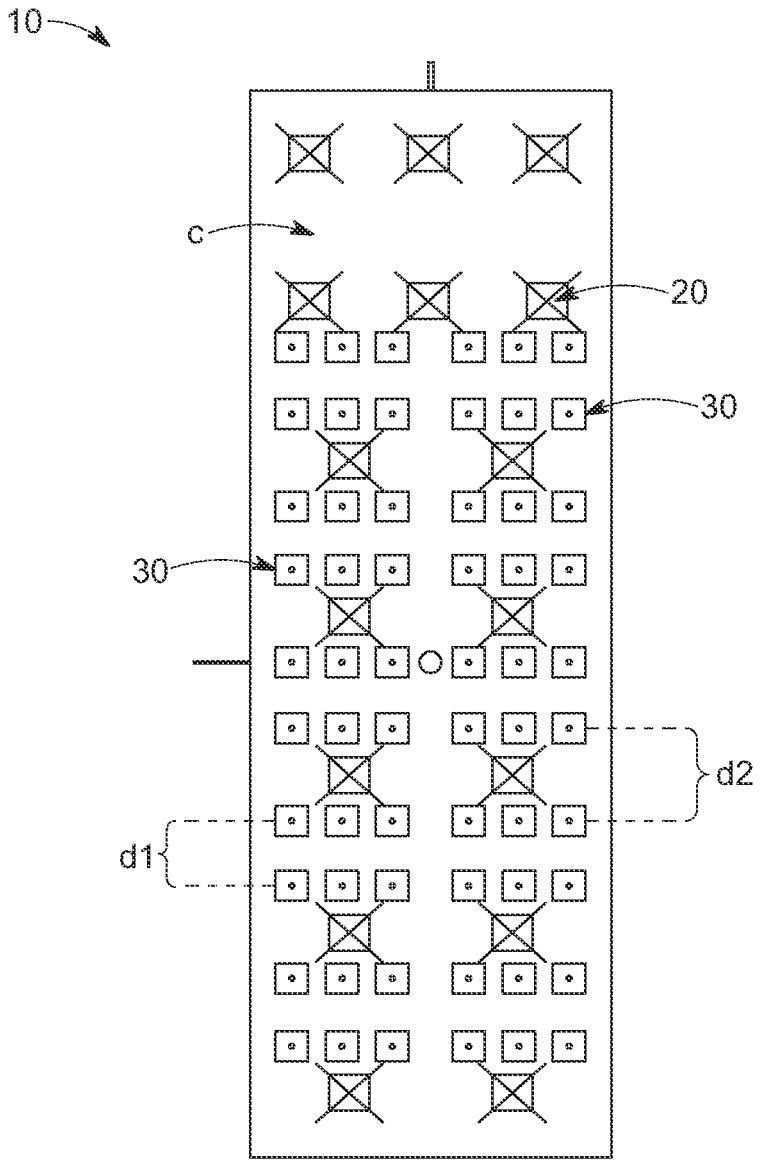
FIG. 8 shows front view of another embodiment of the present invention where the antenna system is a dual band antenna system with two independent high band antenna arrays each with one 33 degree beam per polarization and a low band antenna with one 33 degree beam per polarization and a new 3322222 architecture.

Referring to FIG. 8, an antenna system corresponding to Embodiment C listed above is illustrated. This embodiment provides two high band antenna arrays and a single low band antenna array. The first high band antenna array is provided by the three leftmost columns of high band antenna array elements while the second high band antenna array is provided by the three rightmost columns of high band antenna array elements. Each high band antenna array has 30 high band antenna array elements divided into five groups of six elements per group. Each group has two rows of three antenna array elements per row. As can be seen, each group is longitudinally separated from adjacent groups by a distance d2. Within each group, each row is separated from its adjacent row by a distance of d1. In this implementation, d2 is greater than d1.

For the low band antenna array, seven rows of low band antenna array elements are present with the first two rows having three elements per row while the rest of the rows have only two elements per row. A distance c separates the first or top two rows of the low band array. For this implementation, a total of 16 low band antenna array elements were used.

As with the above implementations, for the low band array, dipole antenna array elements were used. For the high band antenna arrays, patch antenna array elements were used.

As noted above, this embodiment the high-band and low-band arrays each have 33 degree bore sight beams. However, the configuration for this embodiment may be equally applied to 45 degree antennas, or other antennas with varying degrees of bore sight beams.

Figure 9:
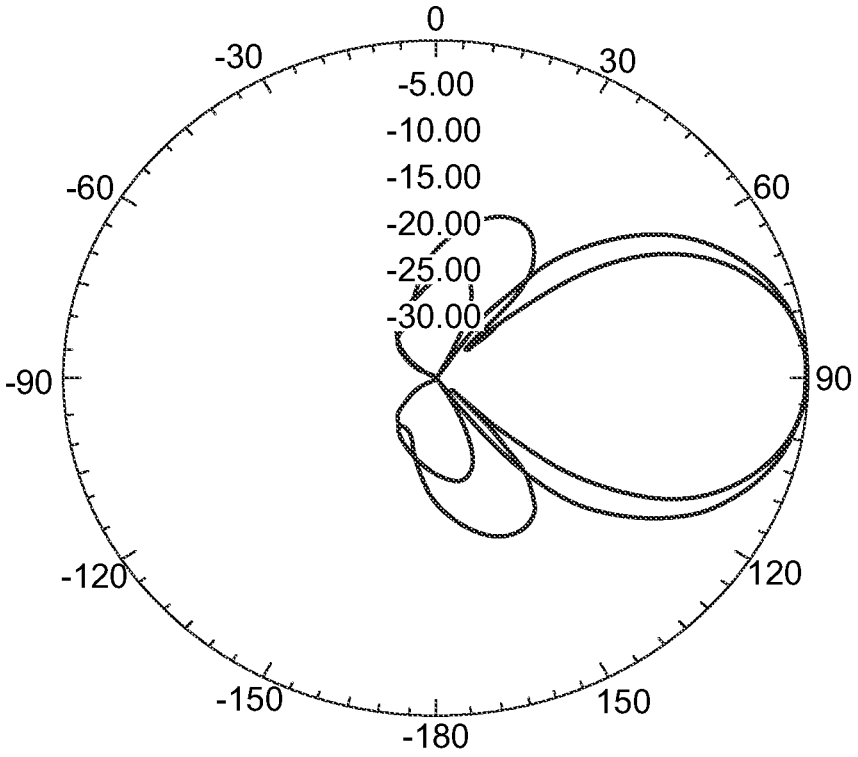
FIGS. 9 and 9A illustrates simulated azimuth patterns for the antenna system illustrated in FIG. 8 with 33 degree bore sight beams for both lowband and highband frequencies.

Referring to FIG. 9, presented is a graphical representation of the azimuth pattern for the B-band of the antenna shown in FIG. 8 with results simulated at 743 MHz and 860 MHz.

Figure 9A:
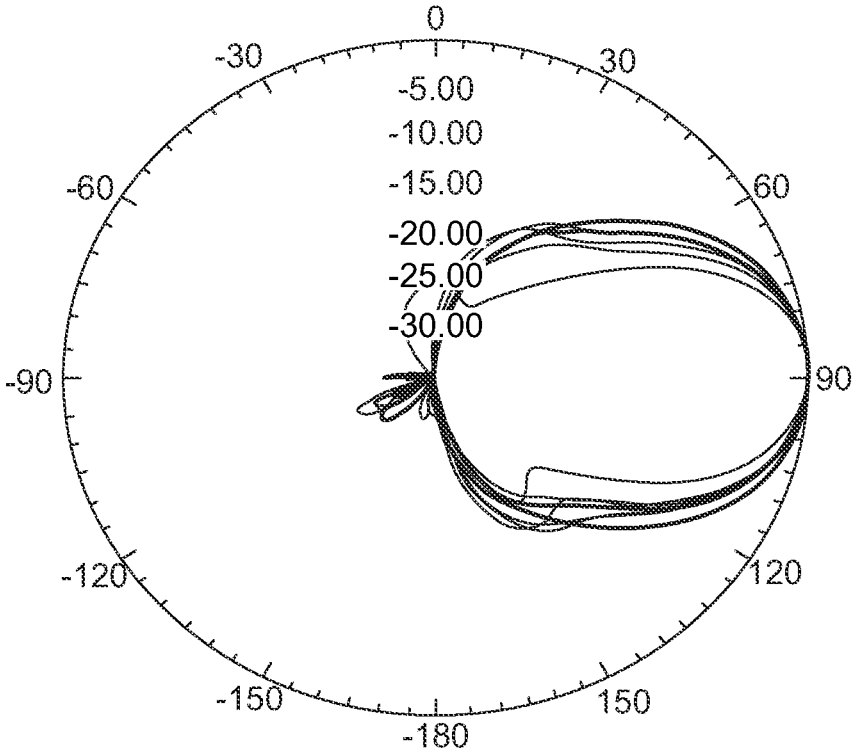

Referring to FIG. 9A, presented is a graphical representation of the azimuth pattern for the high-band beams of the antenna shown in FIG. 8 simulated from 1.71 GHz to 2.36 GHz. The red line represents 1.71 GHz, the purple line represents 1.85 GHz, the blue line represents 1.94 GHz, the maroon line represents 1.99 GHz, the green line represents 2.045 GHz, the pink line represents 2.17 GHz and the teal line represents 2.36 GHz.

Figure 10:
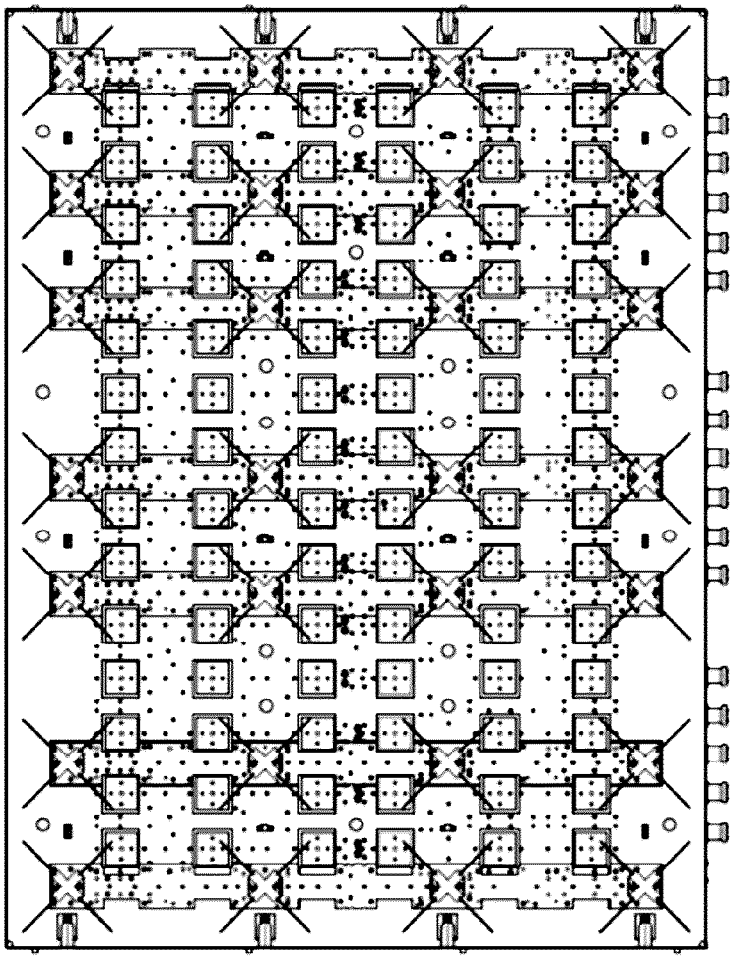
FIG. 10 shows a front view schematic of another embodiment of the present invention as an antenna for producing 3-6 beams.

Referring to FIG. 10, presented is a front view schematic of an antenna system corresponding to Embodiment D listed above. As noted above, this configuration produces six high band beams per polarization and three low band beams per polarization. There are two antenna arrays in this configuration—one high band antenna array and one low band antenna array. In this embodiment, the antenna system has 14 columns and 6 rows of high band antenna array elements along with 7 columns and 4 rows of low band antenna array elements. Both the longitudinal and latitudinal spacings for both the low band and high band arrays are non-uniform to improve the pattern quality.

Figure 11:
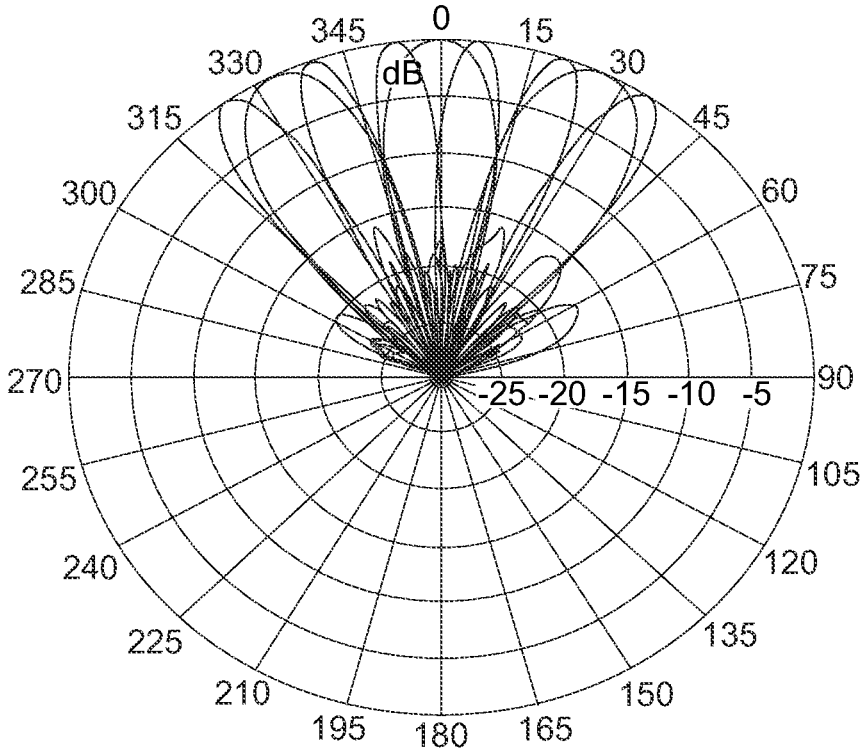
FIG. 11 shows azimuth and elevation patterns for the embodiment of the present invention shown in FIG. 10.
Figure 11:
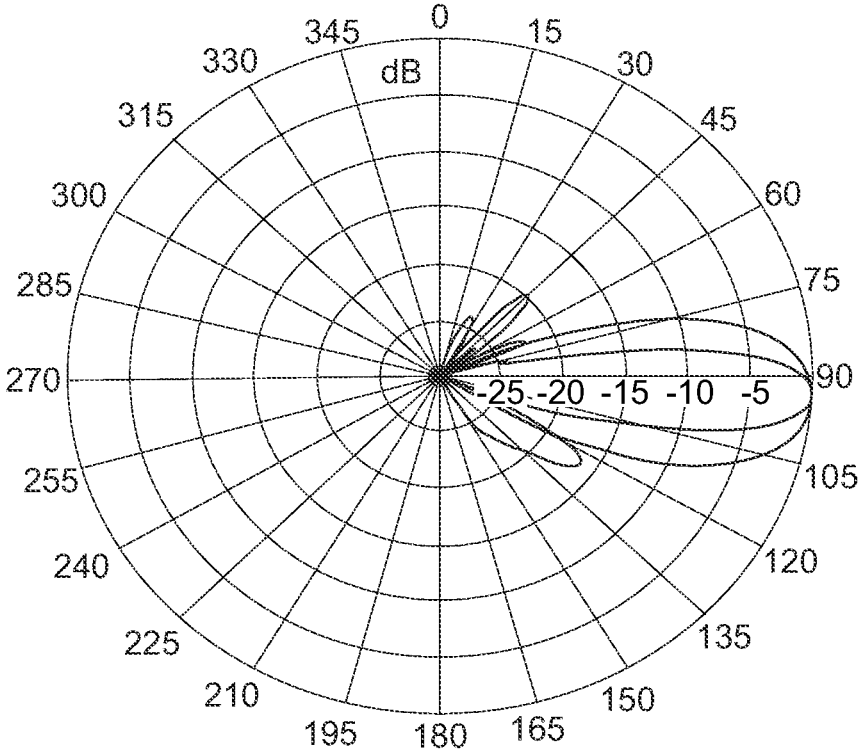

FIG. 11 shows the azimuth and elevation patterns for the antenna system illustrated in FIG. 10. These results were obtained at a low frequency band of 796 MHz and at a high frequency band 1940 MHz.

It should be noted that other embodiments of the present invention are possible. Another possible embodiment produces five low frequency band beams and ten high frequency band beams. This embodiment would have 20 columns and 6 rows of high frequency band antenna array elements and 10 columns and 4 rows of low frequency band antenna array elements. Preferably, for this embodiment, the latitudinal and longitudinal spacings between antenna array elements are non-uniform.

A person understanding this invention may now conceive of alternative structures and embodiments or variations of the above all of which are intended to fall within the scope of the invention as defined in the claims that follow.

What is claimed is:

1. An antenna system comprising:

a first antenna array located on a reflector plane having a longitudinal axis comprising:

a plurality of linear arrangements of first antenna elements each in horizontal axes in said reflector plane, each linear arrangement being perpendicular to said longitudinal axis in said reflector plane, said first antenna elements being for use with low frequency band signals;

a plurality of linear arrangements of second antenna elements, also in horizontal axes in said reflector plane, each linear arrangement being perpendicular to said longitudinal axis in said reflector plane, each linear arrangement of second antenna elements having a plurality of second antenna array elements, said second antenna elements being for use with high frequency band signals;

wherein said linear arrangements of second antenna elements on horizontal axes in said reflector plane with said longitudinal axis are located separate from, and in between said linear arrangements of first antenna elements along non overlapping and parallel horizontal axes, and wherein said first antenna array has at least two linearly arrangements of second antenna elements, each in independent horizontal axes, between each linear arrangement of first antenna elements;

said first antenna elements are of a first type of antenna array elements;

said second antenna elements are of a second type of antenna array elements;

each of said first antenna elements is at a different non-overlapping horizontal location along said longitudinal axis from any of said second antenna elements; and each of said first antenna array elements and each of said second antenna array elements is a single band antenna element, wherein at least some of said second antenna elements are grouped into a plurality of horizontal groups on said horizontal axes, wherein each of said horizontal groups of second antenna elements include one second antenna element from one linear arrangement of second antenna elements on one of said horizontal axes and another second antenna element from another one of said linear arrangement of second antenna elements on another one of said horizontal axes, said second antenna elements in said horizontal group being located on either side of one of said linear arrangements of first antenna array elements.

2. An antenna system according to claim 1, wherein each linear arrangement of second antenna elements is longitudinally separated from adjacent linear arrangements between said linear arrangements of first antenna elements by a first predetermined spacing.

3. An antenna system according to claim 2, wherein within each group of two second antenna elements disposed in two different linear arrangements of second antenna elements separated by a linear arrangement of first antenna elements, each second antenna element is longitudinally separated from by a second predetermined spacing.

4. An antenna system according to claim 3, wherein said first predetermined spacing is different from said second predetermined spacing.

5. An antenna system according to claim 3, wherein said first predetermined spacing is lesser than said second predetermined spacing.

6. An antenna system according to claim 1, wherein said first antenna array elements are dipole antenna array elements.

7. An antenna system according to claim 1, wherein said second antenna array elements are patch antenna array elements.

8. An antenna system according to claim 1, wherein at least linear arrangements of said first antenna array elements have different numbers of first antenna array elements per row.

9. An antenna system according to claim 1, wherein the antenna system produces multiple beams.

10. An antenna system according to claim 1, wherein said antenna system is a dual-beam dual-band antenna system.

11. An antenna system according to claim 7, wherein at least one group of patch antenna array elements are fed from a back of patch antenna array elements by one hybrid integrated four column beamformer.

12. An antenna system according to claim 6, wherein at least one dipole antenna element is fed from a bottom or a top of a reflector of said antenna system.

13. An antenna system according to claim 11, wherein said hybrid integrated beamformer has two splitters at its output, one equal and one non-equal to produce asymmetrical weightings for said patch antenna array elements.

14. An antenna system according to claim 11, wherein said hybrid integrated beamformer is used to remove a dispersion from crossover and to stabilize a sidelobe level of beams produced by said antenna system.

15. An antenna system according to claim 13, wherein said hybrid integrated beamformer applies a switch approach between said linear arrangements of second antenna elements which reverses asymmetry to remove a dispersion from crossover and to stabilize a sidelobe level.

* * * * *